US008853602B2

(12) United States Patent
Nakamura

(10) Patent No.: US 8,853,602 B2
(45) Date of Patent: Oct. 7, 2014

(54) DRAWER TYPE COOKING DEVICE

(75) Inventor: Tatsuhiko Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 478 days.

(21) Appl. No.: 12/700,405

(22) Filed: Feb. 4, 2010

(65) Prior Publication Data

US 2010/0200575 A1 Aug. 12, 2010

(30) Foreign Application Priority Data

Feb. 6, 2009 (JP) ..... 2009-026015

(51) Int. Cl.
*H05B 6/68* (2006.01)
*H05B 6/76* (2006.01)
*H05B 6/64* (2006.01)

(52) U.S. Cl.
CPC ..... *H05B 6/6414* (2013.01); *H05B 6/763* (2013.01)
USPC ..... 219/756; 219/739; 219/678; 219/385

(58) Field of Classification Search
USPC ..... 219/756, 736–738; 312/330.1–348.6
See application file for complete search history.

(56) References Cited

U.S. PATENT DOCUMENTS 5,449,231 A * 9/1995 Lin ..... 312/334.18
6,435,636 B1 * 8/2002 MacMillan ..... 312/334.46
6,474,757 B2 * 11/2002 Hall et al. ..... 312/127
6,747,757 B1 * 6/2004 Enomoto ..... 358/1.9
2004/0227444 A1 * 11/2004 Booker et al. ..... 312/334.45
2005/0236408 A1 * 10/2005 Schulte ..... 219/737
2006/0289512 A1 12/2006 Iwamoto

FOREIGN PATENT DOCUMENTS

JP 2006-223336 * 8/2006
JP 2006-223336 A 8/2006
JP 2006-329492 12/2006

OTHER PUBLICATIONS

Japanese Office Action issued Aug. 28, 2012.

* cited by examiner

*Primary Examiner* — Matthew Reames
*Assistant Examiner* — John Bodnar
(74) *Attorney, Agent, or Firm* — Birch, Stewart, Kolasch & Birch, LLP

(57) ABSTRACT

The invention provides a drawer type cooking device, wherein the mounting positions of roller-shaped shock absorbing members 10*b* and 10*b* attached to a drawer body 2 are either aligned with portions of the side walls 3*b* and 3*b* of the heating chamber 3 where fixing angles 8 of the slide rails 7 are attached and thus having enhanced rigidity, or arranged close to a bottom wall 3*c* of the heating chamber 3, so that when a biased operation force is applied to the door, the generation of a gap between a front side panel of the cooking device body 1 and the inner side of the door is suppressed, and the occurrence of a microwave leakage through the gap caused by not stopping the generation of microwave until the operation of a latch is thereby prevented in advance.

5 Claims, 5 Drawing Sheets

DRAWER TYPE COOKING DEVICE

The present application is based on and claims priority of Japanese patent application No. 2009-26015 filed on Feb. 6, 2009, the entire contents of which are hereby incorporated by reference.

BACKGROUND OF THE INVENTION

1. Field of the Invention

The present invention relates to drawer type cooking devices belonging to built-in kitchen equipment such as microwave ovens built into furniture or cabinets, for example.

2. Description of the Related Art

There has been proposed in the prior art, cooking devices, each having a drawer body formed integrally with a door capable of being drawn out to the front side of the cooking device. Such drawer type cooking devices are suitably applied to designed kitchens where a plurality of cooking devices are arranged three-dimensionally, since they can be built into the area below the kitchen countertop without occupying the space above the countertop. Therefore, drawer type cooking devices are characterized as cooking devices suitably applied to fitted kitchens or designed kitchens, and the use thereof is recently spreading widely, especially in the United States.

The present applicant has proposed one example of a drawer type microwave oven in Japanese patent application laid-open publication No. 2006-223336 (patent document 1), disclosing a drawer type cooking device comprising a cooking device body having a heating chamber, a drawer body disposed movably in the cooking device body and capable of being drawn out to the exterior from within the heating chamber of the cooking device body, and slide rails for moving the drawer body within the cooking device body, wherein the slide rails are disposed on the exterior of the heating chamber so as to enable the slide mechanism to be formed without using members or materials having high heat resistance and frame resistance, and also to prevent the occurrence of discharge failures caused by microwave.

Safety standards for microwave ovens are established in the respective countries, but in the United States which has a model safety standard for such respective standards, safety standards UL 923 related to microwave ovens have been established as UL (Underwriter's Laboratories) standards. According to UL 923, it is necessary that the microwave oven does not cause microwave leakage when the door is at a closed state, and in addition, it is also necessary that microwave leakage from the heating chamber does not occur even during an abnormal state of use where external force or foreign objects are applied to the microwave oven without using any tools during the heating operation using microwave (electromagnetic wave with a frequency of about 2450 MHz).

One of the test conditions for confirming that the microwave oven conforms to the UL standards related to microwave leakages include a condition in which a horizontal torsional force is applied to the door during heating operation in such a range that the supply of microwave is not stopped. In drawer type microwave ovens, latches for controlling the main switch of the microwave generation device are disposed at two locations on left and right sides of the microwave oven as gap detection means, but since much weight is put on the visual appearance and design of the front side of the cooking device body when the door is opened, these latches are disposed at deep areas within the cooking device body. In the case of drawer type cooking devices, for example, the door is designed to be opened electrically when the main switch disposed on the left side thereof is turned off. However, according to the test condition described above, the door is opened while applying torsional force to the door, and only the main switch disposed on one side is turned on. In other words, when a user attempts to open the door by holding only the right end side of the door handle, only the right side of the door starts to open with the left side of the door still closed, and the latch will only move sideways with the main switch still continued to be switched on, so that the operation of the cooking device, that is, the operation of the microwave generating device, will not stop. As a result, microwave leakage will occur from the gap formed at the partially opened door.

The above-described test for confirming whether microwave leakage occurs under such condition will hereinafter be referred to as "jerk microwave leakage test" for sake of convenience in the present application. In the case of a door so-called an open handle door that can be gripped both via ordinary gripping and backhand gripping, by each hand, the user can grasp at almost any place on the handle; so, the manual "leverage" thus applicable to the door can be significant, making it likely to have twisting displacement of the door enough to cause jerk microwave leakage. However, if the latch structure is designed to have a high sensitivity so that the latch activates even by a slight displacement and the main switch of the microwave generation device is turned off in order to avoid such leak from occurring, the latch may activate erroneously even when a slight shock is applied to the device during heating operation and the heating operation will be discontinued, according to which latch alignment becomes difficult and the productivity of the microwave oven is deteriorated. Furthermore, since the stress such as the door opening and closing operation during use may cause the sensitivity of the latch to vary with time, such a sensitive latch structure is not preferable from the viewpoint of product reliability.

In widely used microwave ovens disposed on countertops, the doors open and close either in the horizontal or vertical direction via a hinge, and when a horizontal torsional force is applied to open the door by the user holding one end of the door during heating operation, the latch is released immediately and the supply of microwave is stopped instantly. Therefore, such widely used microwave ovens do not have difficulty in satisfying the jerk microwave leakage test standards.

On the other hand, according to drawer type microwave ovens, when the opening of the door is detected via the left and right latches disposed on the heating chamber, the supply of microwave is stopped immediately, but when a door opening force biased to one side is applied to the door, the detection operation of the latch is dispersed among respective microwave ovens depending on specific product structures, and the operation becomes uncertain. Therefore, unlike the microwave ovens adopting the above-mentioned hinge structure, it is important for drawer type microwave ovens that the jerk microwave leakage test is performed both at the time of designing the product and at the time of test production.

According to the drawer type microwave oven disclosed in patent document 1, the drawer body with a door is movably disposed via a slide mechanism constituting a movement mechanism disposed at three locations, at both left and right side walls and the bottom wall at the outer side of the heating chamber within the cooking device body, for automatically opening and closing the door. However, in order to absorb the mutual dimensional dispersion of the drawer body and the heating chamber during production, the dimensional relationship of the drawer body and the heating chamber is set so that when the drawer body is stored in the heating chamber, a predetermined clearance is formed between the drawer body and the walls of the heating chamber at horizontal direction and at the bottom, excluding the upper area which is opened to enable food to be taken into and out of the heating chamber.

According to the drawer type microwave oven disclosed in patent document 1, when external force is applied to the drawer body, in order to prevent the drawer body from moving the distance corresponding to the clearance and to prevent the outer side of the drawer body from directly colliding against the inner side of the heating chamber, multiple pairs of roller-shaped shock absorbing members are axially supported rotatably on the outer side of the leading end of the drawer body (the depth side corresponding to the storing direction of the drawer body) so as to relieve the impact and to realize a sliding movement with respect to the inner side of the heating chamber.

The multiple pairs of shock absorbing members are arranged so that at least one pair of lower shock absorbing members are axially supported horizontally via a rotation axis near the bottom surface of the drawer body so as to realize the shock absorbing operation in the lower direction and to enable sliding movement, and another at least one pair of side shock absorbing members are axially supported perpendicularly above the lower shock absorbing members via a rotation axis so as to realize the shock absorbing operation in the side direction and to enable sliding movement.

According further to the prior art drawer type microwave ovens, the side shock absorbing members are disposed near the center in the vertical direction of the side panels of the heating chamber, and when collision occurs to the side walls of the heating chamber placed adjacent to the side shock absorbing members, the side walls are elastically deformed so as to relive the stress applied to the side shock absorbing members. In other words, the reliability of the arrangement is improved by adopting an arrangement where the side walls of the heating chamber are deformed by receiving stress, so that the areas of the side wall panels of the heating chamber corresponding to the fixing positions of the side shock absorbing members are designed so as not to have components secured thereto via welding, screw engagement and so on.

According to the prior art drawer type microwave oven with shock absorbing members, when horizontal torsional force is applied to extreme end portions such as the end of the door of the drawer type microwave oven or the end of the door handle, a horizontal rotational moment pivoting around a vertical axis is applied to the drawer body, and in that state, the drawer body applies pressure via the shock absorbing member to the side panel of the heating chamber on the side where the drawer body approximates the inner side of the side panel of the heating chamber. When the side panel of the heating chamber elastically deforms in response to this pressure, the drawer body moves in pivoting motion, and when the door is at a closed state, a biased gap is formed between the front panel of the heating chamber and the inner side of the door as a result.

When the drawer body moves in such a manner to create a biased gap in one direction, since the latch will not activate until the gap widens to a certain degree and the supply of microwave will not stop, microwave leakage is likely to occur through the gap. As a result, the structure of the drawer type microwave ovens may not satisfy the standards of the jerk microwave leakage test.

As described, in order to prevent the occurrence of microwave leakages in a jerk microwave leakage test when horizontal torsional force is applied to the door, it is necessary to prevent gaps from occurring between the front panel of the heating chamber and the inner side of the door.

Therefore, when the thickness of components constituting the heating chamber is reduced with the aim to reduce the weight and cost of the product, even if the mechanical strength of the heating chamber composed of the thin components satisfies a sufficient safety factor, microwave leakage may occur by the elastic deformation of the side panel of the heating chamber during the jerk microwave leakage test. There is a drawback that the occurrence of such microwave leakage makes it impossible to reduce the thickness of the components constituting the heating chamber.

One possible solution of the problem is to reduce the thickness of the components constituting the heating chamber while enhancing the rigidity of the side panels of the heating chamber so as to prevent elastic deformation of the side panels, but if reinforcements are added to the components constituting the heating chamber, the cost-reduction effect by the reduction in thickness of the components constituting the heating chamber is diminished, and in some cases, the cost is even increased, so that solutions other than adding reinforcements and increasing the number of components are desired.

Furthermore, since drawer type cooking devices are generally disposed at positions closer to the floor surface compared to general cooking devices, they are distanced from the view of the user, and in actual use, the user may bump against the drawer body when the door is at a opened state, and a strong shock may be applied to the user if the drawer body is supported with high rigidity. Therefore, from the viewpoint of safety, it is not preferable to increase the rigidity of the side panels of the heating chamber by increasing the plate thicknesses thereof.

Moreover, the door handle has a protruded circular-arc shape, so that the user can perform pulling and pushing operations by gripping only the center area since there is a sufficient clearance formed between the handle and the front side of the door at the center, but at both ends the handle approximates the front side of the door so as not to enable the user to grip the ends, according to which torsional force can be prevented from being applied easily to the door during the jerk microwave leakage test. Therefore, the user may feel inconvenience since the handle gripping area is restricted to the center area even when the width of the drawer type microwave oven is very large.

Since the door handle of a drawer type cooking device is subjected to such significant restrictions, even if a door handle design simply extending linearly in the horizontal direction is preferred from the viewpoint of coordination to unify and integrate the interior design of the whole kitchen, such handle design cannot be adopted in a product if the device does not conform to the jerk microwave leakage test. As a result, drawer type microwave ovens are not adopted in the above-mentioned type of interior designed kitchens, and therefore, the widening of sales volume is inhibited. Thus, a solution is desired for preventing the occurrence of microwave leakages during the jerk microwave leakage test even when the design of the door handle is selected to be coordinated with the kitchen interior design.

As described, the problem to be solved in drawer type cooking devices is to provide a drawer type cooking device having an outer casing, an inner casing fit to the interior of the outer casing and constituting a heating chamber having a front side opened, a drawer body having an integrally disposed door for opening and closing the opening of the heating chamber and capable of moving into and out of the heating chamber via a slide mechanism, and a shock absorbing member for preventing the outer side of the drawer body from directly colliding against the inner side of the heating chamber, wherein the areas opposed to the shock absorbing members of the side wall panels of the inner casing constituting the heating chamber are reinforced using existing components.

The object of the present invention is to provide a drawer type cooking device having reduced the thickness of the components constituting the heating chamber, capable of reinforcing the inner casing without additionally providing reinforcement members to the components constituting the heating chamber, which had led to increase of number of components and manufacturing costs.

SUMMARY OF THE INVENTION

The present invention aims at solving the problems of the prior art by providing a drawer type cooking device comprising an outer casing having a front side panel with a rectangular opening, an inner casing fit to the outer casing and having a rectangular parallelepiped shape, with a heating chamber formed in the interior thereof having an opening at a front side thereof corresponding to the opening of the outer casing, a drawer body having a drawer-type loading portion capable of being moved into and out of the heating chamber and a door disposed integrally in a partition-like manner to the front side of the loading portion, at least a pair of shock absorbing members disposed on both outer sides of left and right sides of the loading portion and opposed to side panels of the inner casing, and a slide mechanism having fixed-side moving members disposed on an outer side of the inner casing and movable-side moving members disposed on the drawer body and capable of moving in sliding motion by engaging with the fixed-side moving members for guiding the drawer body to be moved into and out of the heating chamber, wherein the fixed-side moving members of the slide mechanism are fixed to rear sides of portions of the side walls of the inner casing opposed to the pair of shock absorbing members when the door is at a closed state.

According to the present drawer type cooking device, fixed-side moving members of the slide mechanism for guiding the drawer body into and out of the heating chamber are fixed to the rear sides of the portions of the side panels of the inner casing facing at least one pair of shock absorbing members disposed on the outer side of the left and right sides of the loading portion constituting the drawer body when the door is at a closed state, so that the relevant portions of the side panels of the inner casing are reinforced by the fixed side moving members.

According to the present drawer type cooking device, when the door is at a closed state, the pair of shock absorbing members are in internal contact with the side panels at areas close to bent bottom corners of the inner casing where the bottom panel intersects with the side panels of the inner casing.

The present drawer type cooking device has refined the positions in which the existing components or fixed-side moving members are attached, so as to enable the inner casing to be reinforced without providing additional reinforcement members to the components of the inner casing forming the heating chamber, and therefore, without increasing the number of components and increasing the manufacturing costs thereof.

Further according to the present drawer type cooking device, the pair of shock absorbing members are in internal contact with the side panels at areas near the bent corner portions of the bottom panel where the bottom panel of the inner casing intersects with the side walls when the door is at a closed state, so that the elastic deformation of the side walls of the heating chamber caused by the side shock absorbing members can be further suppressed due to the rigidity of the bottom panel and the bent corner portions of the bottom panel.

DETAILED DESCRIPTION OF THE PREFERRED EMBODIMENTS

Figure 1:
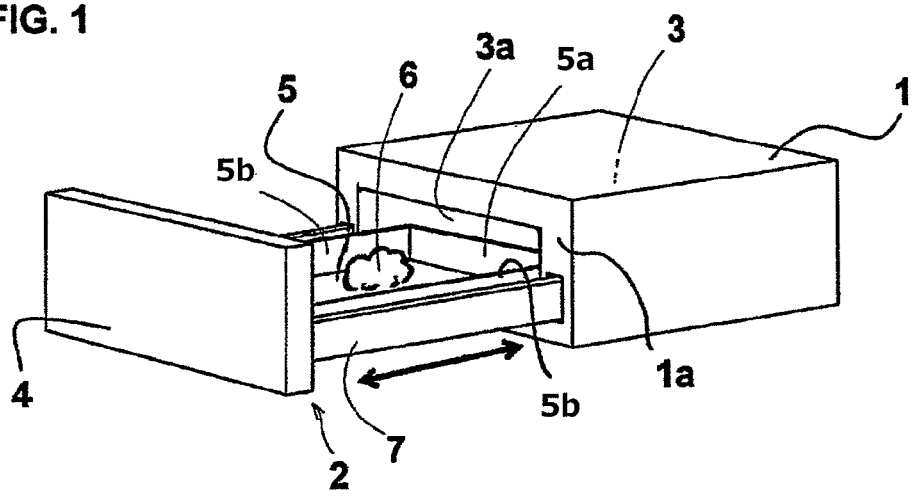
FIG. 1 is an external perspective view of a drawer type cooking device according to the present invention.
Figure 2:
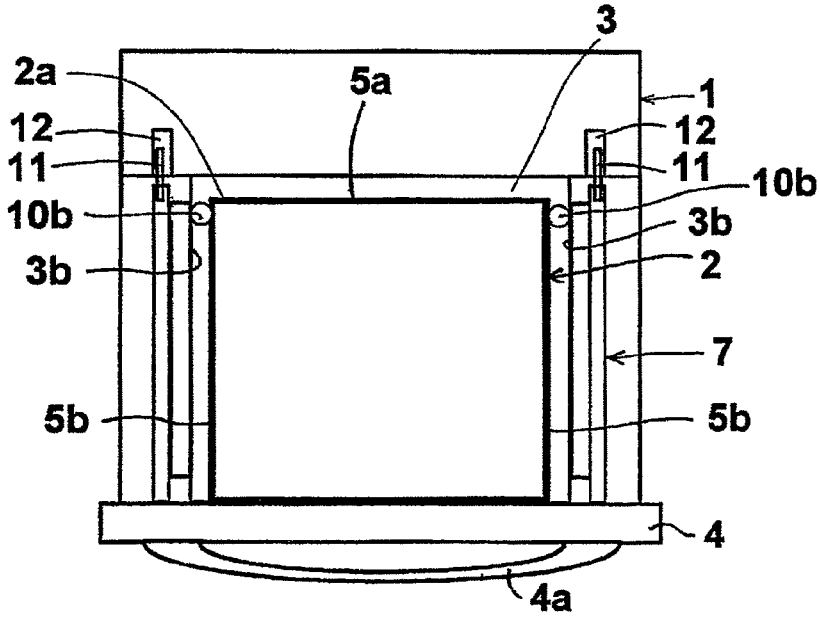
FIG. 2 is a cross-sectional schematic view showing the arrangement of shock absorbing members of the drawer type cooking device illustrated in FIG. 1.
Figure 3:
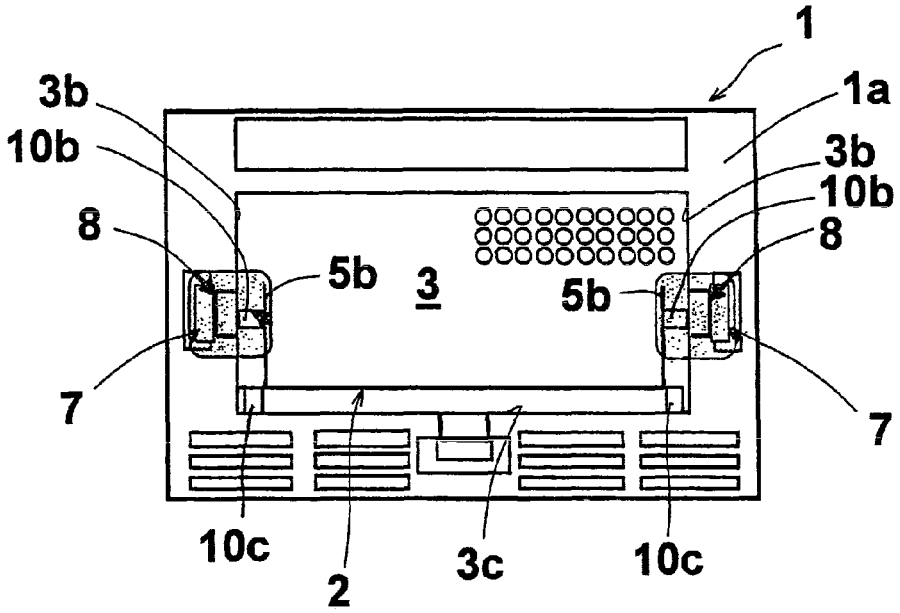
FIG. 3 is a partially cross-sectional front view showing the drawer type coking device having shock absorbing members as illustrated in FIG. 2 with the door removed.
Figure 4:
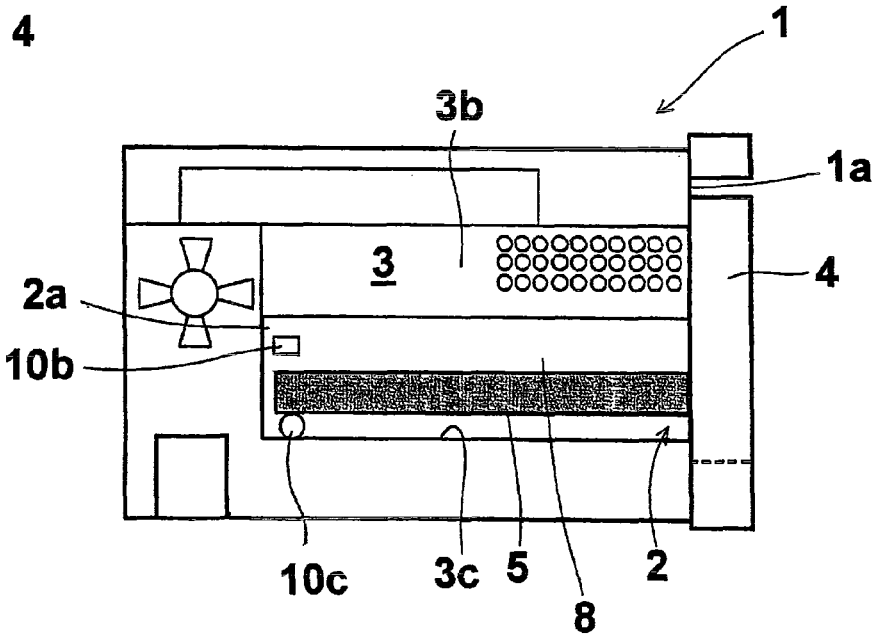
FIG. 4 is a schematic cross-sectional side view showing the drawer type cooking device having shock absorbing members illustrated in FIG. 2 with the drawer body stored.
Figure 5:
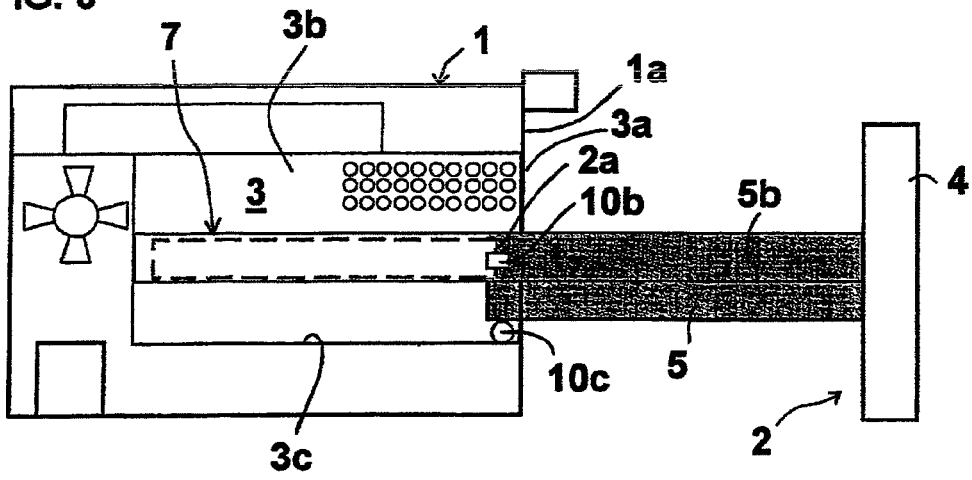
FIG. 5 is a schematic cross-sectional side view showing the drawer type cooking device illustrated in FIG. 4 with the drawer body drawn out.

Now, the preferred embodiments of the drawer type cooking device according to the present invention will be described with reference to the drawings. FIGS. 1 through 5 illustrate a drawer type microwave oven as one preferred embodiment of the drawer type cooking device according to the present invention. As shown in FIG. 1, a cooking device body 1 includes a heating chamber 3 for heating and cooking an object 6 to be heated. A drawer body 2 is movably disposed in the cooking device body 1 so that the drawer body can be drawn out from within the heating chamber 3 of the cooking device body 1 toward the direction of the arrow. The cooking device has a slide mechanism including slide rails 7 as a mechanism for moving the drawer body 2 within the cooking device body 1. The drawer body 2 is equipped with a door 4 for opening and closing an opening 3*a* formed in the front side of the heating chamber 3, and a container-like table 5 capable of loading thereon the object 6 to be heated and capable of being moved in and out through the opening of the heating chamber 3. The table 5 has a read wall 5*a* erected on the rear side of the table and side walls 5*b* and 5*b* erected on the left and right sides so as to surround the table 5, wherein the upper area is opened to enable the object 6 to be heated to be taken into and out of the table, and on the front side of the table is attached a door 4 via engagement or the like. When the door 4 closes the opening 3*a* of the heating chamber 3, the internal space of the heating chamber 3 is formed as a sealed space defined by the inner walls of the cooking device body 1 and the drawer body 2.

The cooking device body 1 comprises an outer casing, and in the interior of the cooking device body 1, the heating chamber 3 is formed by assembling and welding metal panels or the like as an inner casing having an opening 3*a* formed in the front side thereof. The cooking device body 1 has a heating chamber assembly having assembled a front side panel 1*a* which is a substantially rectangular metal panel having an opening that corresponds to the opening 3*a*. Slide rails 7 for guiding the drawer body 2 slidably with respect to the cooking device body 1 are disposed at three locations on the outer side of the heating chamber 3, that is, on both outer sides of the left and right sides thereof and the outer side of the bottom portion thereof. A driving mechanism using an electric motor can be assembled with the slide rail disposed on the outer side of the bottom portion thereof, and in that case, the drawer body 2 can be automatically drawn out and stored via the drive mechanism. In the stored position where the table 5 is completely stored in the heating chamber 3, the door 4 can close the opening on the front side panel 1*a* (opening of the heating chamber 3).

Figure 6:
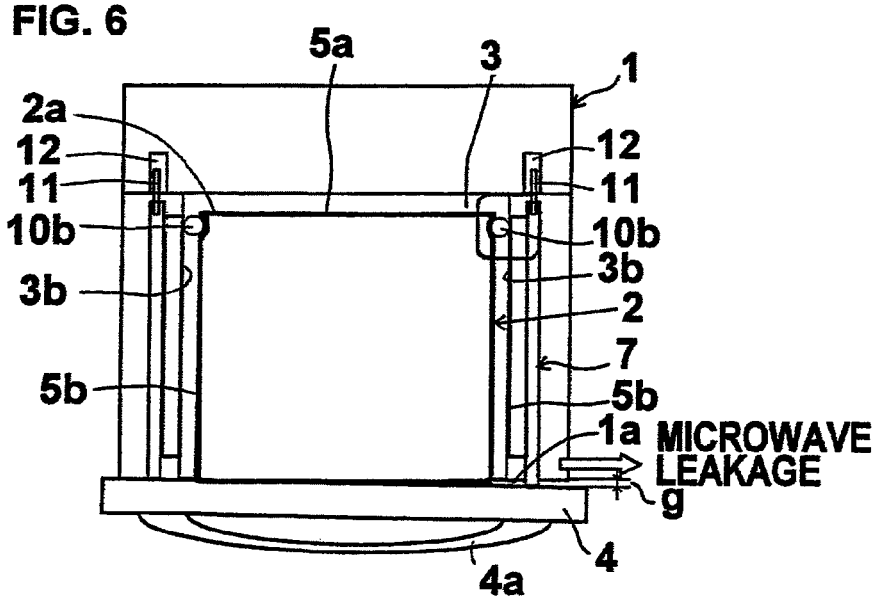
PRIOR ART FIG. 6
FIG. 6 is a schematic cross-sectional plan view of a prior art drawer type cooking device.

In microwave ovens, a latch mechanism as gap detection means must be disposed so as to ensure the operation of a switch for starting and stopping the power supply to the heating source during the opening and closing of the door 4. The latch mechanism is operated to ensure positive engagement when the door 4 is at a closed state, and to enable prompt separation when the door 4 is opened. As for the location of the latch mechanism, since the drawer body 2 moves linearly in the horizontal direction in drawer type cooking devices, the latch mechanism can be disposed in any arbitrary position from the position near the front side panel 1*a* of the cooking device body 1 to the area near the rear end of the slide rail 7. An example is illustrated (FIG. 2, FIG. 6) in which latch heads 11 and 11 are disposed on the deepest ends of the slide rails 7, and latch hooks 12 and 12 capable of being engaged with the latch heads 11 and 11 when the door 4 is at a closed state are disposed on the inner side of the depth wall of the heating chamber 3, so that the latch switch is turned on when the latch heads 11 and 11 are engaged with the latch hooks 12 and 12, but the latch mechanism can also be disposed on two symmetric portions on the left and right sides of the opening 3*a* near the front side panel 1*a*.

When the drawer body 2 is at a stored state in the heating chamber 3, a clearance in the horizontal direction exists between the drawer body 2 and the inner walls (side walls 3*b* and 3*b* and bottom wall 3*c*) of the heating chamber 3. Therefore, when the drawer body 2 is moved crookedly in the horizontal direction, the outer side wall of the drawer body may collide against the inner wall of the heating chamber 3 at the depth portion, and if the drawer body is opened or closed in that manner, the drawer body may scrape against the inner side of the heating chamber 3. In order to prevent such collision and scraping from occurring, a roller assembly 10 in which roller-shaped shock absorbing members formed of plastic material are supported in axially-rotatable manner on the outer side of the end portion 2*a* of the drawer body 2 in an intervened position with the inner wall of the heating chamber 3. The roller assembly 10 is composed of side shock absorbing members 10*b* and 10*b* exerting a shock absorbing action with respect to the side walls 3*b* and 3*b* of the heating chamber 3, and a lower shock absorbing member 10*c* exerting a shock absorbing action with respect to the bottom wall 3*c* of the heating chamber 3.

During the jerk microwave leakage test, when a force to twist the door 4 in the horizontal direction is applied to the door 4 by holding one end of the handle 4*a*, one of the side shock absorbing members 10*b* and 10*b* is pushed against the wall surface of the side wall 3*b* of the heating chamber 3. The thickness of the side walls 3*b* and 3*b* of the heating chamber 3 is reduced year by year, since the side walls are not required to ensure mechanical strength. Further, the side walls 3*b* and 3*b* are designed to elastically deform when pressing force is applied thereto from the side shock absorbing members 10*b* and 10*b*. Therefore, when the drawer body 2 is operated to move in a horizontally torsional manner, the roller assembly 10 is designed so that the side shock absorbing members 10*b* and 10*b* relieve the shock of collision against the side walls 3*b* and 3*b*, and as for the moving operation, the roller-shaped shock absorbing members are rotated so as to prevent the drawer body from scraping against the side walls 3*b* and 3*b*.

As illustrated in FIGS. 6 through 9, according to prior art cooking devices (microwave ovens), the side shock absorbing members 10*b* and 10*b* are disposed at positions close to the lower shock absorbing member 10*c*, and the areas of the side walls 3*b* and 3*b* where the side shock absorbing members 10*b* and 10*b* come into contact therewith are basically not reinforced. As a result, when the drawer body 2 moves in a horizontally torsional manner, the roller-shaped side shock absorbing member 10*b* corresponding to the direction of distortion comes into contact with the side wall 3*b* of the heating chamber 3, and the side wall 3*b* elastically deforms and is displaced in the direction in which the side shock absorbing member 10*b* is pressed against the wall. The drawer body 2 is displaced further toward the direction of distortion by the displacement of the side wall 3*b*, by which a gap g is formed between the front side panel 1*a* and the inner side of the door 4, through which microwave leakage occurs. The present inventor has discovered through comprehensive analysis of the results of repeated jerk microwave leakage tests of the prior art cooking devices that the microwave leakages occurring during the tests are caused by such structural factor.

Based on such discovery, the collision of the drawer body 2 of the side walls 3*b* and 3*b* of the heating chamber 3 itself is considered to be caused only during transportation for distribution of cooking device products, but in the present invention, the consideration to the shock absorbing effect during collision of the drawer body 2 to the side walls 3*b* and 3*b* is set as a low priority item, and higher priority is given to conform to the jerk microwave leakage test. In other words, when the thickness of the heating chamber components is reduced, the rigidity of the contact portions of the side walls 3*b* and 3*b* of the heating chamber where the upper side shock absorbing members 10*b* and 10*b* come into contact therewith is increased such as by utilizing angle components 8 of the slide rails 7, so that the contact portions of the side walls 3*b* of the heating chamber 3 will not deform by the pressure applied from the side shock absorbing members 10*b*, and the drawer body 2 will not be displaced in the torsional direction. In this manner, no gap will be formed between the front side panel 1*a* of the cooking device body component and the inner side of the door 4 of the drawer body 2, according to which a microwave leakage-free drawer type microwave oven capable of passing the jerk microwave leakage test can be obtained.

Other possible measures for forming a microwave leakage-free drawer type microwave oven capable of passing the jerk microwave leakage test while reducing the thickness of the components of the heating chamber and enhancing the rigidity of the side walls 3*b* and 3*b* of the heating chamber 3 include increasing the thickness of the plate members, especially the side walls 3*b* and 3*b*, constituting the heating chamber 3, disposing reinforcement ribs to the side walls 3*b* and 3*b*, or additionally providing reinforcement members to the areas of the side walls 3*b* and 3*b* where side shock absorbing members 10*b* and 10*b* come into contact therewith. However, it is difficult to actually adopt such measures, since they run counter to the intension of reducing the weight of the device and cutting down the costs thereof.

In the present drawer type microwave oven, the areas of the heating chamber 3 occupied by the side shock absorbing members 10*b* and 10*b* when the drawer body 2 is at a stored state in the heating chamber 3 are aligned with the attachment areas of fixing angles 8 and 8 arranged on the rear side of the side walls 3*b* and 3*b* of the heating chamber 3 for attaching the slide rails 7 and 7 to the cooking device body 1. According to such aligned arrangement, at the contact positions where the side shock absorbing members 10*b* apply pressure to the side walls 3*a* and 3*a* of the heating chamber 3, the fixing angles 8 and 8 reinforce the side walls 3*b* and 3*b* from behind so that the rigidity of the side walls 3*b* and 3*b* is increased. Further, since the pressing force of the side shock absorbing members 10*b* and 10*b* applied on the side walls 3*b* and 3*b* is received by the reinforced side walls 3*b* and 3*b*, the deformation of the side walls 3*b* and 3*b* can be suppressed. Thus, since no gap g is formed between the front side panel 1*a* of the cooking device body 1 and the inner side of the door 4, microwave leakage will not occur during the jerk microwave leakage test, and the present drawer type microwave oven will pass the jerk microwave leakage test.

As described, according to the present invention, when the plate thickness of the side walls 3*b* and 3*b* of the heating chamber 3 is reduced, the rigidity of the contact portion of the side walls 3*b* and 3*b* of the heating chamber 3 coming into contact with the side shock absorbing members 10*b* and 10*b* can be improved without attaching additional reinforcement members, so that the costs for manufacturing the heating chamber 3 can be cut down. Furthermore, even if the door handle 4*a* adopts a linear pole shape design disposed in parallel to the front side of the door enabling the user to hold and apply a door opening/closing force at arbitrary positions instead of the door handle shape design enabling the user to only hold the center portion so as not to apply any torsional force to the door 4, the present cooking device can prevent microwave leakage through the door caused by the operating force of the user, and the design limitation of the door handle can substantially be solved.

Figure 7:
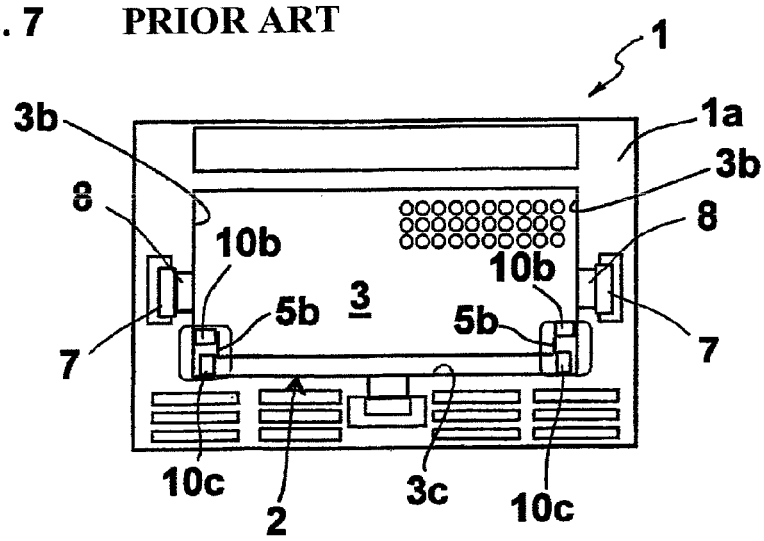
FIG. 7 PRIOR ART
FIG. 7 is a partially cross-sectional front view of the prior art drawer type cooking device illustrated in FIG. 6 with the door removed.
Figure 8:
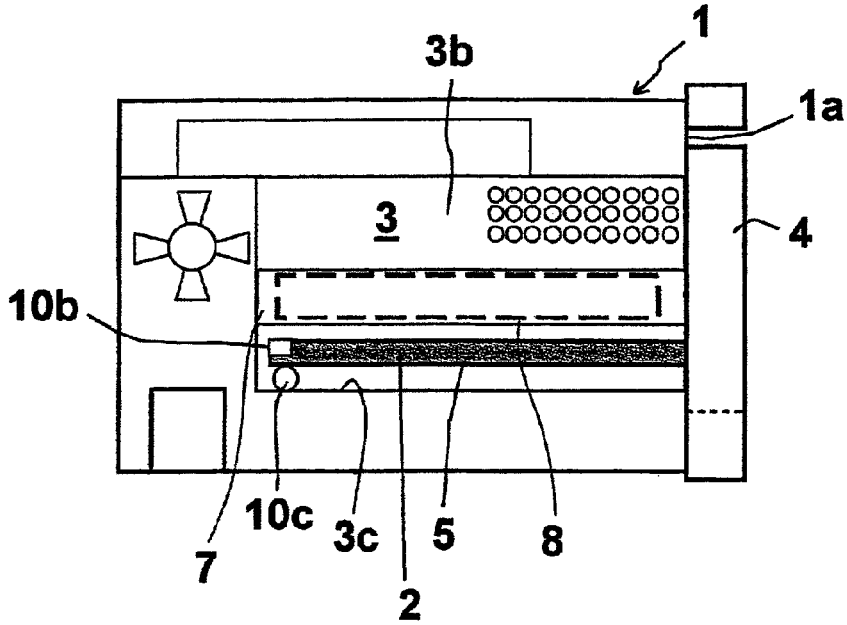
FIG. 8 PRIOR ART
FIG. 8 is a schematic cross-sectional side view of the prior art drawer type cooking device illustrated in FIG. 6 with the drawer body stored.
Figure 9:
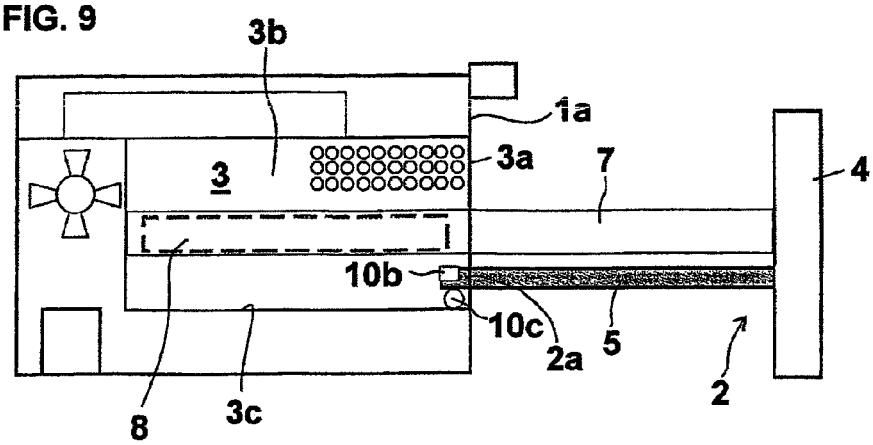
PRIOR ART FIG. 9
FIG. 9 is a schematic cross-sectional side view of the prior art drawer type cooking device illustrated in FIG. 6 with the drawer body drawn out.

Further, when the panel thickness of the side walls 3*b* and 3*b* of the heating chamber 3 is reduced, as shown in FIG. 7, it is possible to arrange the upper roller-shaped side shock absorbing members 10*b* and 10*b* near the bent bottom corner portions where the bottom wall 3*c* of the heating chamber 3 formed as an inner casing intersects with the side walls 3*b* and 3*b* when the door 4 is at a closed state. According to such arrangement, the side shock absorbing members 10*b* and 10*b* come into contact with the corner portions of the bottom wall where the structural rigidity is highest in the heating chamber 3 and therefore is least likely to deform, according to which the elastic deformation of the side walls 3*b* and 3*b* of the heating chamber 3 can be suppressed even further, which is desirable since distortion of the drawer body 2 is less likely to occur. According to the present example, even when the panel thickness of the structural members of the heating chamber 3 is reduced, the strength of the side walls 3*b* and 3*b* of the heating chamber 3 is sufficient so that it will not be elastically deformed by the pressure applied thereto from the drawer body 2. Therefore, microwave leakage will not occur during the jerk microwave leakage test according to the present drawer type microwave oven, and the microwave oven will pass the jerk microwave leakage test.

The above-described arrangement of the present invention is desirable, since when the panel thickness of the side walls 3*b* and 3*b* of the heating chamber 3 is reduced, the side walls will still have sufficient rigidity with respect to the rotation of the drawer body when the door is at a completely closed state, which corresponds to the state of the jerk microwave leakage test, but when the door is at a opened state, the rotation of the drawer body is supported in a flexible manner by the elastic force of the side wall panels of the heating chamber, so that even if the user bumps against the drawer body from the side direction, the shock thereof is desirably relieved.

What is claimed is:

1. A drawer type cooking device comprising:

an outer casing having a front side panel with a rectangular opening;

an inner casing with left and right side panels, a rear panel, and top and bottom panels, fit to the outer casing and having a rectangular parallelepiped shape, including a heating chamber formed in the interior thereof having an opening at a front side thereof corresponding to the opening of the outer casing, wherein the left and right side panels are elastic;

a drawer body having a drawer-type loading portion capable of being moved into and out of the heating chamber, and a door disposed integrally in a partition-like manner to the front side of the loading portion;

a slide mechanism having fixed-side moving members disposed on an outer side of the inner casing and movable-side moving members disposed on the drawer body and capable of moving in sliding motion by engaging with the fixed-side moving member, for guiding the drawer body to move into and out of the heating chamber;

one or more pairs of shock absorbing members disposed on outer sides of both left and right sides of the loading portion so as to oppose the side panels of the inner casing on the inside of the heating chamber, wherein the areas of the side panels opposed to the shock absorbing members are reinforced by a portion of the fixed-side moving members in order to reduce elasticity at the areas, wherein the shock absorbing members come in contact with the respective side panels; and at least a pair of gap detection means disposed on left and right sides of the opening for detecting the generation of a gap, when the door opens from a closed state and a gap is generated between the front side panel and the door, before the gap widens to a distance enabling microwaves to leak therethrough from the heating chamber to the exterior, where when a door opening force is applied to an extreme end portion of the door when the door is at a closed state, either one of the gap detection means detects the generation of a gap.

2. The drawer type cooking device according to claim 1 wherein the fixed side moving members are fixed to rear sides of portions of the side panels of the inner casing opposed to the pair of shock absorbing members when the door is at a closed state.

3. The drawer type cooking device according to claim 1, wherein when the door is at a closed state, the pair of shock absorbing members are in internal contact with the side panels at areas close to where the bottom panel intersects with the side panels of the inner casing.

4. A drawer type cooking device comprising:

an outer casing having a front side panel with a rectangular opening;

an inner casing with left and right side panels, a rear panel, and top and bottom panels, fit to the outer casing and having a rectangular parallelepiped shape, including a heating chamber formed in the interior thereof having an opening at a front side thereof corresponding to the opening of the outer casing, wherein the left and right side panels are elastic;

a drawer body having a drawer-type loading portion capable of being moved into and out of the heating chamber, and a door disposed integrally in a partition-like manner to the front side of the loading portion;

a slide mechanism for guiding the drawer body to move into and out of the heating chamber;

one or more pairs of shock absorbing members disposed on outer sides of both left and right sides of the loading portion so as to oppose the side panels of the inner casing on the inside of the heating chamber, wherein the left and right side panels of the inner casing are reinforced where they oppose the shock absorbing members in order to reduce the elasticity of the side panels.

5. A drawer type cooking device comprising:

an outer casing having a front side panel with a rectangular opening;

an inner casing with left and right side panels, a rear panel, and top and bottom panels, fit to the outer casing and having a rectangular parallelepiped shape, including a heating chamber formed in the interior thereof having an opening at a front side thereof corresponding to the opening of the outer casing, wherein the left and right side panels are elastic;

a drawer body having a drawer-type loading portion capable of being moved into and out of the heating chamber, and a door disposed integrally in a partition-like manner to the front side of the loading portion;

a slide mechanism having fixed-side moving members disposed on an outer side of the inner casing and movable-side moving members disposed on the drawer body and capable of moving in sliding motion by engaging with the fixed-side moving member, for guiding the drawer body to move into and out of the heating chamber;

wherein areas of the side panels where the drawer-type loading portion applies a pressing force to the side panels are reinforced by a portion of the fixed-side moving members so as to reduce elasticity of the areas for moving the drawer body in a horizontally torsional manner without deformation.

* * * * *